United States Patent [19]

Verch

[11] 3,990,933

[45] Nov. 9, 1976

[54] TAPE APPLYING DEVICE

[75] Inventor: John T. Verch, Hastings, Minn.

[73] Assignee: Minnesota Mining and Manufacturing Company, St. Paul, Minn.

[22] Filed: Sept. 25, 1975

[21] Appl. No.: 616,637

Related U.S. Application Data

[62] Division of Ser. No. 432,061, Jan. 9, 1974, Pat. No. 3,909,339.

[52] U.S. Cl. ..... 156/250; 156/468; 156/522; 156/576

[51] Int. Cl.[2] ..... B32B 31/00

[58] Field of Search..... 156/522, 265, 468, 477 R, 156/478–482, 527, 576, 577, 579, 250; 93/36.9; 226/93, 196

[56] References Cited

UNITED STATES PATENTS

| | | | |
|---|---|---|---|
| 2,596,158 | 5/1952 | Lindsey | 156/522 X |
| 2,727,783 | 12/1955 | Erickson | 156/522 X |
| 3,027,292 | 3/1962 | Rothenberger | 156/468 |

*Primary Examiner*—David A. Simmons
*Attorney, Agent, or Firm*—Alexander, Sell, Steldt & DeLaHunt

[57] ABSTRACT

A device used in the application of a length of tape to a substrate comprising a pair of opposed brushes mounted along the edges of a path for the tape. The bristles of the brushes engage and position an end portion of the supply length of tape.

6 Claims, 9 Drawing Figures

TAPE APPLYING DEVICE

This is a division of application Ser. No. 432,061, filed Jan. 9, 1974, now U.S. Pat. No. 3,909,339.

BACKGROUND OF THE INVENTION

The present invention relates to devices for applying tape which include means for positively supporting an end portion of a supply length of pressure sensitive adhesive tape when the device is not in use.

Some prior art tape applying devices support an end portion of a supply length of tape from a position spaced a significant distance from its terminal end so that the projecting end can be pressed into engagement with a surface to which the tape is to be applied. Such projecting ends can fold and move out of position, however, particularly when the tape has a thin flexible backing. While air pressure or electrostatic means can be used to help properly position such projecting ends, use of such means complicates the applicator and is not suitable for many portable applicators.

Other prior art tape applying devices mechanically engage the tape adjacent its end. The means for engaging the tape in known devices of this type, however, have typically either been in a position where they interfere with the application of tape to a surface, or are so complex as to be inappropriate for use in many devices.

SUMMARY OF THE INVENTION

According to the present invention there is provided an improved device for applying lengths of tape to a substrate from a supply length of tape, which device includes a simple and inexpensive means for positively supporting the end portion of the supply length of tape which does not interfere significantly with application of the first surface portion of the head to allow the end portion of the tape to be pressed into engagement with a substrate. During application the head moves along the tape being applied and the position of the head relative to the substrate changes. After the change the second peripheral surface portion of the head presses against the tape being applied, and a spring moves the brushes so that they again re-engage the supply length of tape which is guided and tensioned along the first surface portion. The applied length of tape is then severed from the supply length between the two surface portions, with the newly severed end portions supported by the brushes.

BRIEF DESCRIPTION OF THE DRAWING

The present invention will be further described with reference to the accompanying drawing wherein like numbers refer to like parts in the several views, and wherein.

DESCRIPTION OF A PREFERRED EMBODIMENT

Figure 4:
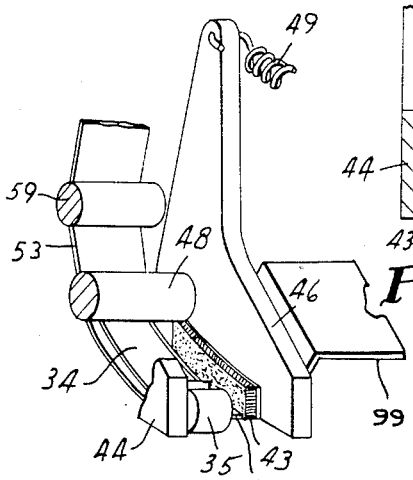
FIG. 4 is an enlarged fragmentary perspective view illustrating one of a pair of brushes for supporting tape along a taping head in the device of FIG. 1.
Figure 3:
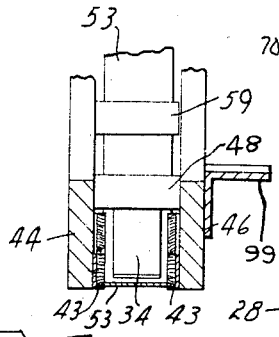
FIG. 3 is an enlarged fragmentary sectional view taken approximately along the lines 3—3 of FIG. 1.
Figure 5:
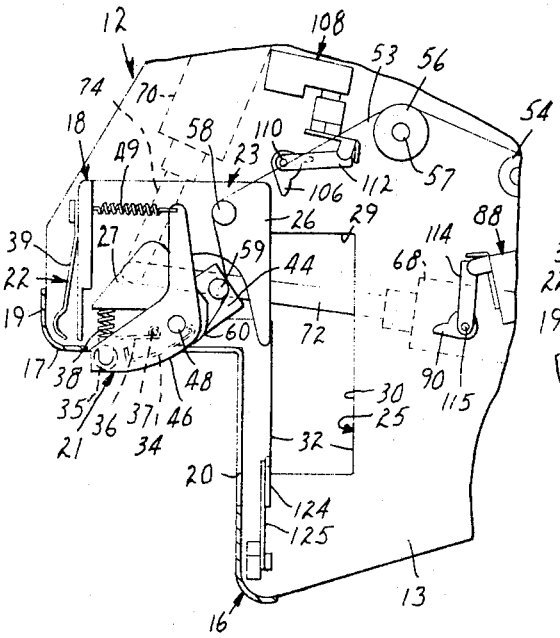
FIGS. 5, 6, 7 and 8 are enlarged fragmentary views, partially in section, of the tape applying head in the device of FIG. 1, which sequentially illustrate positions to which the head moves in applying a length of the tape around the edge of a box.
Figure 6:
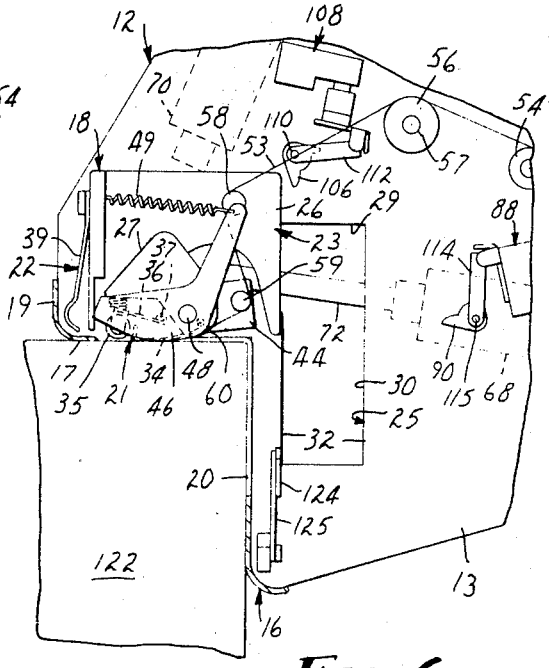
Figure 8:
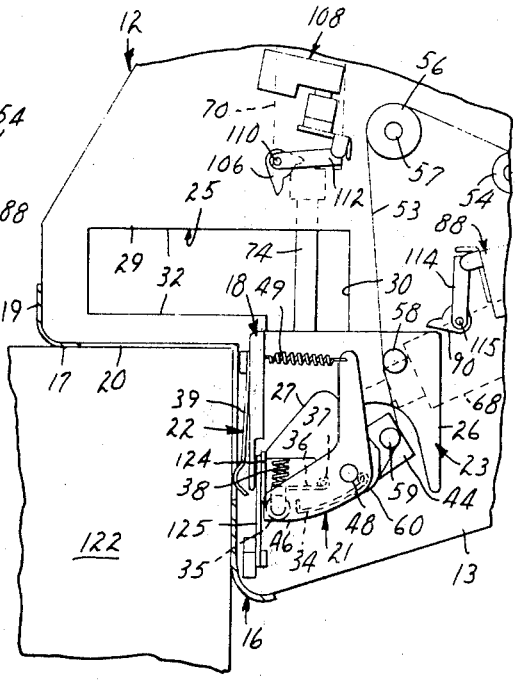

Referring now to the drawing, there is illustrated a portable device according to the present invention, generally designated by the numeral 12, adapted for applying a predetermined length of tape around an edge of a box. The device 12 comprises a frame 13 including a handle 14 adapted for manual engagement to move the device 12 from one box to another, and a guide shoe 16 having an L-shaped contact surface 17 adapted to be positioned in contact with the edge and adjacent surfaces of a box adjacent the area to which tape is to be applied. A tape applying head 18 is mounted on the frame 13 for movement via drive means (which may be manually activated via a trigger 15 pivotally mounted along the handle 14) in a rectilinear path along the guide shoe 16 from a starting position relative to the frame 13 at a first end 19 of the shoe 16 (FIGS. 1, 5 and 6), to a finish position at the other end of the shoe 16 (FIG. 8). During such movement initially a first peripheral surface portion 21 and then a second peripheral surface portion 22 of the head 18 projects through a slot 20 in the guide shoe 16 (FIG. 2) and moves along the tape being applied to press it into engagement with a box. As will be explained in detail herein, the device includes a novel means comprising a pair of opposed brushes 43 for supporting an end part or end portion of the supply length of tape along the first peripheral surface portion 21 of the head 18 when the device 12 is not positioned adjacent a box (FIGS. 3, 4, and 5). The brushes 43 retract so that the end portion of the tape along the first peripheral surface portion 21 will be pressed into engagement with one surface of a box as the guide shoe 16 is positioned thereon (FIG. 6). When the second peripheral surface portion moves into contact with the box during the application of the tape, a spring 49 moves the brushes 43 back into engagement with the tape along the first peripheral surface portion 21. A knife 124 mounted on a spring 125 is positioned to sever the applied length of tape from the supply length between the first and second peripheral surface portions 21 and 22 as the head 18 reaches the finish position (FIG. 8), after which the brushes 43 again support the newly formed tape end portion as the head 18 is returned to the starting position in readiness to again apply a predetermined length of tape to a box.

FIGS. 3 through 8 best illustrate the structure of the tape applying head 18, and its movement from the starting to the finish positions. The taping head 18 comprises a rigid body 23 including a rectangular block 24 slidably mounted in an L-shaped opening 25 in the frame 13 to guide the movement of the head 18 between the starting and finish positions. A first plate 26 is fixedly attached to one side of the rectangular block 24, and a second plate 27 is attached to the side of the first plate 26 opposite the block 24. The first and second plates 26 and 27 support means defining the first and second peripheral surface portions 21 and 22 of the head 18 which will later be explained. A bolt 28 projects from the side of the head 18 opposite the plates 26 and 27, to which bolt 28 is coupled drive means which afford movement of the head 18 between the starting and finish positions.

The rectangular block 24 has a rectangular channel formed around its periphery. The L-shaped opening 25 in the frame 13 extends around the guide shoe 16, with first and second legs 29 and 30 of the opening 25 each being defined by walls 32 spaced a predetermined distance from each other. The walls 32 engage the channel in the rectangular block 24 and afford sliding movement of the tape head 18 between the starting and the finish positions (said first and second positions being defined by abutment of the rectangular block 24 at the opposite ends of the opening 25), with the walls 32 defining the first leg 29 of the opening 25 engaging the channels on two opposite sides when the rectangular block 24 is along the first leg 29, and the walls 32 defining the second leg 30 engaging the channels on the other two opposite sides when the rectangular block 24 is along the second leg 30. Thus the taping head 18 moves between the starting and finish positions without pivoting relative to the frame 13.

The first peripheral surface portion of the head 21 is defined by a leaf spring 34 cantilevered from the second plate 27 of the body 23 and a roller 35 rotatably mounted in a bracket 36. The bracket 36 is pivotally mounted on the second plate 27 about a pin 37, and is biased away from the second plate 27 by a coil spring 38. A curved end of a leaf spring 39 cantilevered from a projection on the first plate 26 defines the second peripheral surface portion 22 of the head 18 which adjoins the first peripheral surface portion 21, at the end of the first peripheral suface portion 21 adjacent the first end 19 of the guide shoe 16. The roller 35 and leaf springs 34 and 39 are sufficiently wide to engage the entire width of the backing or nonadhesive side of the tape, and provide means for affording resilient movement of the first and second peripheral surface portions 21 and 22 under a force applied generally normal thereto.

The roller 35 and leaf spring 34 when not compressed extend past the box contact surface 17 of the guide shoe 16 when the head 18 is positioned along the first leg 29 of the opening 25. When pressed against a box, the guide shoe 16 provides means for positioning the head 18 and the box in the starting position with the first peripheral surface portion 21 compressed to press a tape end part thereon against the box under the influence of the springs 34 and 38, and for forcefully pressing the tape against the box in the shoe as the head moves from the starting position along the first leg 29 of the opening 25. The leaf spring 39 when not compressed extends past the contact surface 17 of the guide shoe 16 when the head 18 is positioned along the second leg 30 of the opening 25, and will be compressed to provide means for forcefully pressing the tape against a box in the shoe 16 as the head 18 moves along the second leg 30 of the opening 25.

The tape engagement means for supporting the end part of a length of tape on the first peripheral surface portion 21 when the device 12 is not positioned adjacent a box, and for supporting the newly formed tape end part along the first peripheral surface portion 21 as the head 18 returns from the finish to the starting position includes a pair of spaced brushes 43. The brushes 43, best seen in FIGS. 3 and 4, each includes a backing supporting a multiplicity of resilient bristles. A preferred material for the brushes 43 is that sold under the trade designation VN-100 Vertically Oriented "Fibre-Tran" by the Minnesota Mining and Manufacturing Company of St. Paul, Minnesota, which comprises 50 denier (about 0.003 inch diameter) nylon bristles which project about 0.15 inch from the backing. The brushes 43 are attached to arm means comprising a pair of spaced arms 44 and 46 and are positioned with their bristles axially parallel, and with the tips of their bristles in opposed relationship. A pin 48 attaches the arms 44 and 46 together, and mounts them on the second plate 27 for pivotal motion from an engage position (FIGS. 1 through 5, 7 and 8) with the brushes 43 flanking opposite sides of the tape along the first peripheral surface portion 21; and a release position (FIG. 6) with the brushes 43 spaced from the first surface portion 21 and positioned on opposite sides of the second plate 27. A spring 49 in tension between the first plate 26 and the arm 46 provides means for biasing the arms 44 and 46 to their engage position. The edge surfaces of the arms 44 and 46 which project beyond the contact surface 17 when the head 18 is in the starting position are adapted for engagement by the surface of a box so that pressing the shoe 16 into engagement with a box will move the arms 44 and 46 to their release position.

In their engage position, the arms 44 and 46 space the brushes 43 so that the ends of the bristles on each brush 43 project for a short distance transverse to the surfaces of the tape from the adjacent edge, thereby offering little resistance to longitudinal movement of the tape along the first peripheral surface portion 21, but restricting movement of tape at a right angle away from the first peripheral surface portion 21. The bristles are sufficiently resilient, however, to deflect over the tape along the first peripheral surface portion 21 as the arms 44 and 46 move between their engage and release positions.

As an example, when used with ½ inch wide tape, brushes having 0.15 inch long 50 denier bristles, preferably are spaced at about 0.440 inch so that the bristles from each brush 43 project about 0.030 inch along the surface of the tape.

The supply of tape on the device includes a 51 of tape supported on a flanged hub 52 rotatably mounted on the frame 13, and a length 53 of tape extending from the roll 51 to the tape applying head 18 past the end of the first peripheral surface portion 21 opposite the second peripheral surface portion 22. A series of rollers having axially corrugated peripheries of a hard plastic support the adhesive surface of the length of tape between the roll 51 and the head 18. These rollers include a first idler roller 54, a second roller 56 mounted on a one-way clutch 57 to prevent its rotation in a direction other than that affording movement of the tape toward the head 18, and a third roller 58 rotatably mounted on the first plate 26 which together with a fourth roller 59 on the arm 44 provides means for guiding the tape along the first peripheral surface portion 21 for any position of the head 18. From the fourth roller 59 the length 53 of tape extends with its backing contacting a curved surface 60 on the second plate 27 of the body 23, and along the first peripheral surface portion 21 between the brushes 43.

The one-way clutch 57 between the second roller 56 and the frame 13 provides means for absorbing tensile forces exerted in the length 53 of tape between the tape roll 51 and the second roller 56 due to inertia in the roll 51 and hub 52 when the device 12 is operated, which forces might otherwise pull the end of tape from between the brushes 43. Also, adhesive contact between length 53 of the tape and the corrugated peripheries of the rollers 54, 56, and 58 provides means for tensioning the length 53 of tape along the first peripheral surface portion 21 during operation of the device 12, thereby causing the bristles of the brushes 43 to deflect over the tensioned tape when the arms 44 and 46 return to their engage positions during travel of the head 18 along the second leg 30 of the opening 25, rather than lifting the tape from the first peripheral surface portion 21.

The drive means includes first and second air cylinders 68 and 70 (FIGS. 1 and 2) each having their piston rods (72 and 74 respectively) pivotally attached via clevices 76 to the bolt 28 which projects from the taping head 18 in a direction normal to its direction of travel along the opening 25. The housings of air cylinders 68 and 70 are each pivotally mounted to the frame 13 by a bolt 77 at one end, and are dispersed at an angle to each other so that the first cylinder 68 controls movement of the head 18 along the first leg 29 of the opening 25, and the second cylinder 70 controls travel of the head 18 along the second leg 30 of the opening 25.

Figure 9:
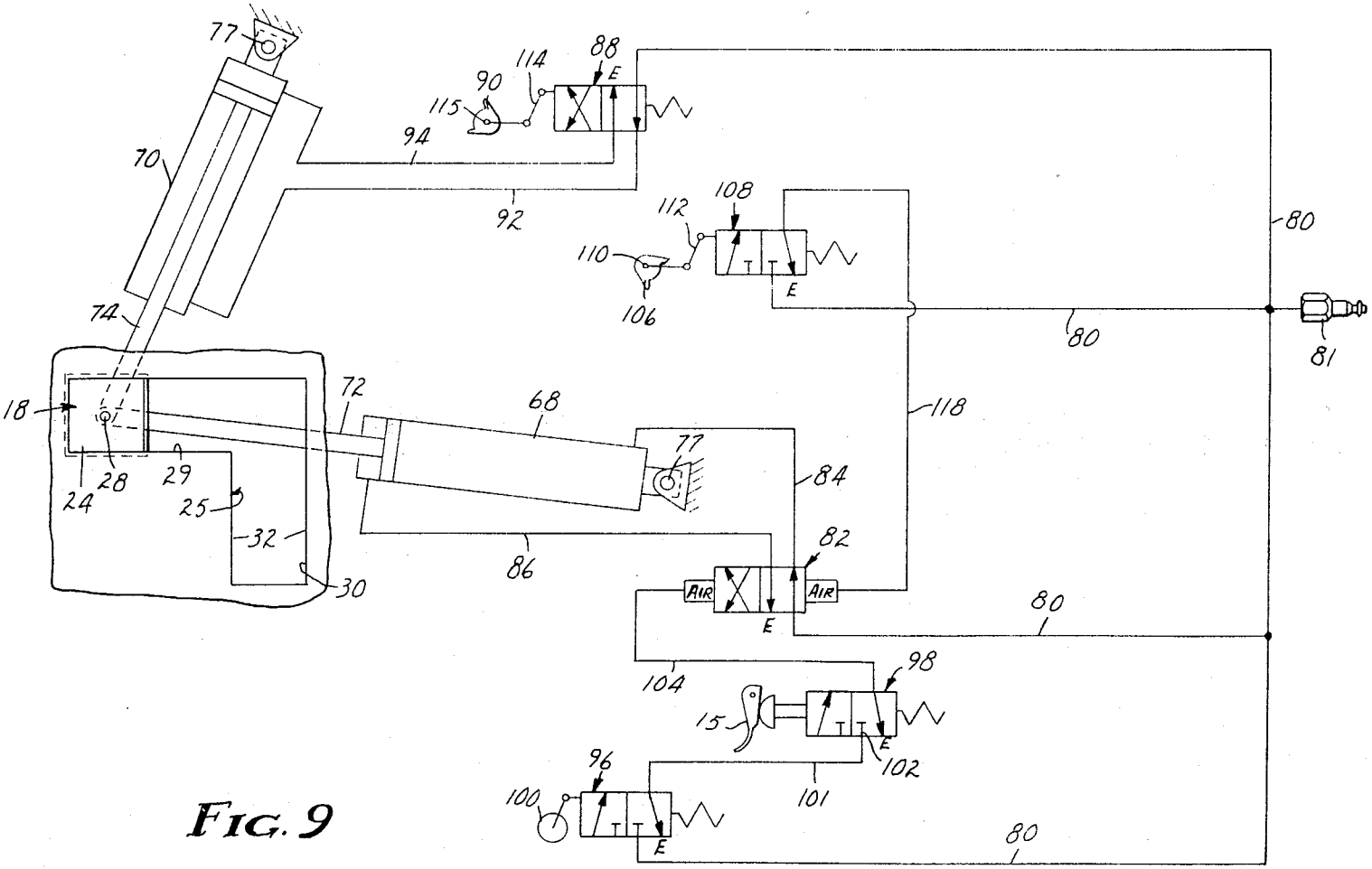
FIG. 9 is a schematic diagram of an air operated drive for the device of FIG. 1 which moves the head in the manner illustrated in FIGS. 5 through 8.

An air control circuit for the air cylinders 68 and 70 is schematically illustrated in FIG. 9 with the use generally of the American Standards Association Fluid Power Symbols. The locations of the various valves in the air control circuit are illustrated in FIGS. 1 through 8, but the air lines have not been illustrated to simplify the drawing.

Figure 1:
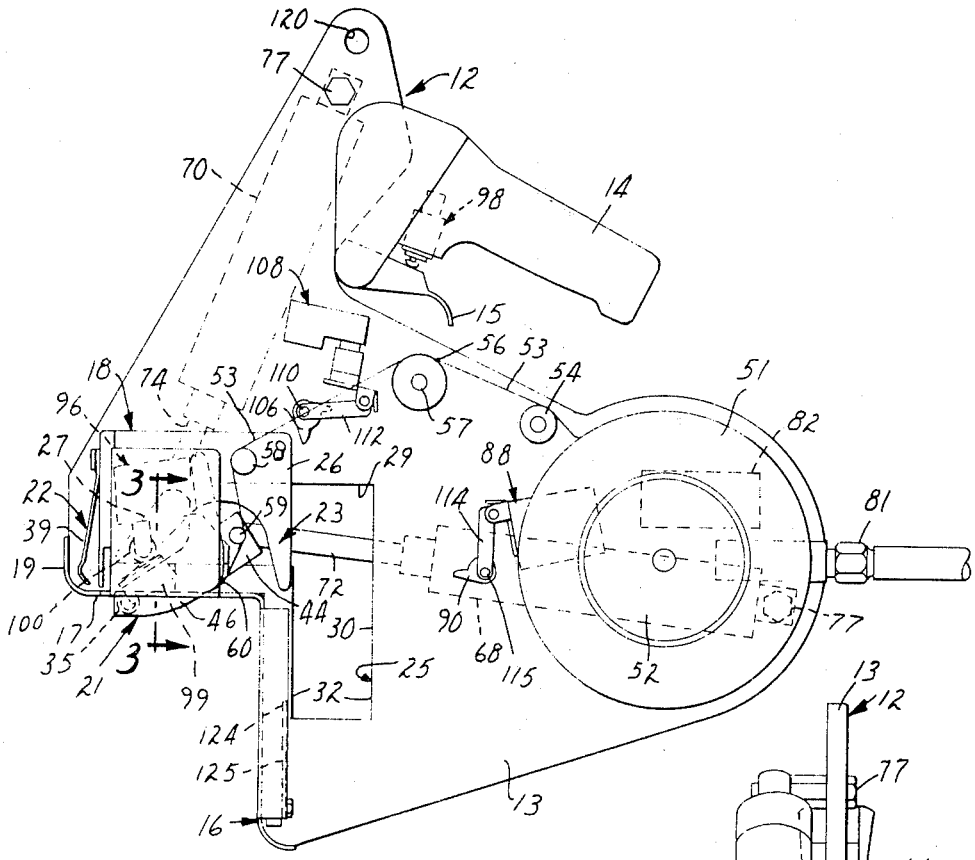
FIG. 1 is a vertical plan view of a tape applying device according to the present invention.
Figure 2:
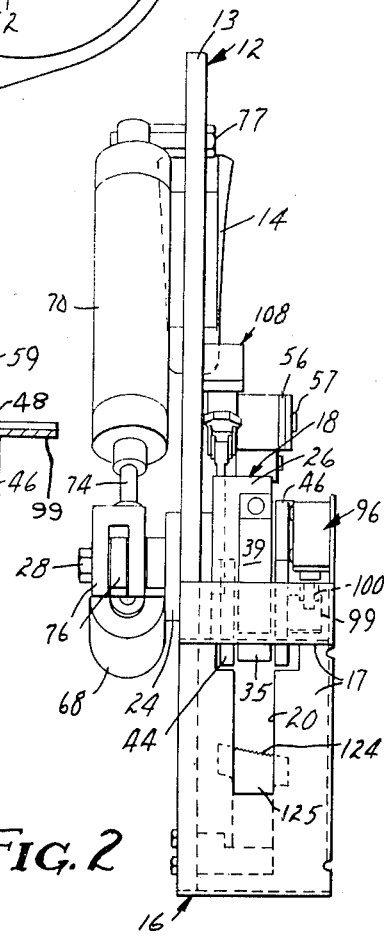
FIG. 2 is a left end view of the device illustrated in FIG. 1.
Figure 7:
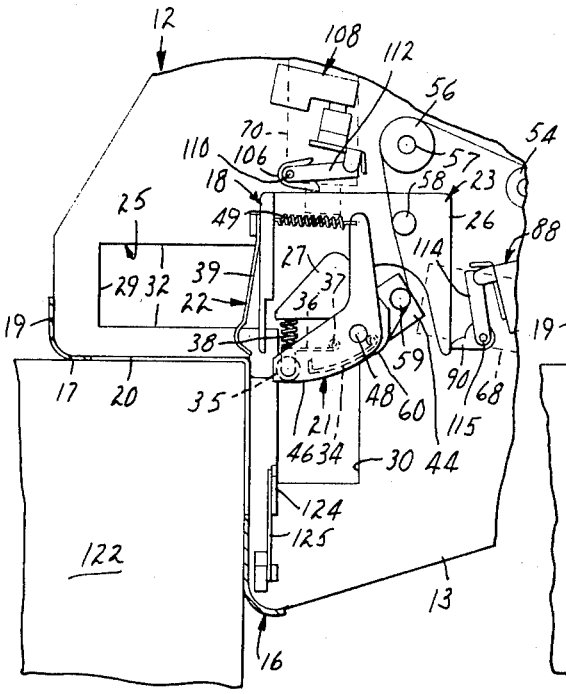

Referring now to FIG. 1 and 9, an air line 80 may be coupled to a source of air under pressure at a male quick disconnect coupling 81. Initially the air line 80 communicates with the first cylinder 68 through a double air pilot operated valve 82 and an air line 84, and the cylinder 68 is exhausted through an air line 86 and the valve 82 to extend the piston rod 72. Also the air line 80 communicates with the second cylinder 70 through a spring return valve 88 actuated by a one-way trip 90, and an air line 92, and the second cylinder 70 is exhausted through an air line 94 and the valve 88 to retract the piston rod 74 into the second cylinder 70. With the piston rod 72 extended and the piston rod 74 retracted, the tape head 18 is positioned at the starting position at the end of the first leg 29 of the opening 25 (FIGS. 5, 6, and 9). The air line 80 also communicates with a closed port of a spring return valve 96 fixed to the shoe 16 which prevents air from reaching a spring return valve 98 operated by the trigger 15, thereby preventing operation of the device 12. When, however, the shoe 16 is pressed against a box causing the arms 44 and 46 to retract (FIG. 6), a bracket 99 fixed to the arm 46 (FIG. 1) engages a roller 100 to move the spool in the spring return air valve 96. This connects line 80 with a line 101 and provides air pressure at a port 102 of the valve 98 operated by the trigger 15. When the operator depresses the trigger 15 the spool of the valve 98 is moved to connect the port 102 with an air line 104, which applies air pressure to move the spool in the air piloted valve 82, thereby applying pressure through the line 86 and exhausting the line 84 to move to piston rod 72 into the cylinder 68. This moves the head 18 toward the end of the first leg 29 of the opening 25 adjacent the cylinder 68 (FIG. 9). During this movement the bracket 99 on the arm 46 moves out of contact with the roller 100, which allows the spool in valve 96 to shift, thereby disconnecting the air line 80 from the line 101 and exhausting the air line 101 so that further manipulation of the trigger 15 will not affect the cycle. Also, the first plate 26 of the taping head 18 contacts a one-way trip 106 on a spring return valve 108, but does not activate the valve 108, as the trip 106 rotates on a pin 110 against the bias of a light spring without moving an actuating arm 112 for the valve 108 (FIG. 7).

When the head 18 reaches the end of the first leg 29 of the opening 25 adjacent the first cylinder 68, the taping head 18 contacts the end of the one-way trip 90 (FIG. 7) which is positioned so that such contact will pivot an arm 114 to move the spool of valve 88, thereby applying pressure through the lines 94 and exhausting line 92 to extend the piston rod 74 from the second cylinder 70. This moves the taping head 18 along the aligned second leg 30 of the opening 25. The rectangular block 24 will not catch on the corner between the legs 29 and 30 of the opening 25 because the cylinder 68 pulls the head 18 against the adjacent wall 32. The first plate 26 of the body 23 slides along the trip 90 to maintain actuation of the valve 88 to an end position of the head's 18 travel along the second leg of the opening 25 defined when the body 23 moves beyond the trip 90 (FIG. 8). When the trip 90 is released, the spool in valve 88 returns to its normal position, applying pressure to the line 92 and exhausting the line 94 to retract the piston rod 74 and return the taping head 18 along the second leg 30 of the opening 25. During this return movement, the tape head 18 will again contact the trip 90, which will now pivot around a pin 115 against a light spring without moving the actuating arm 114 for the valve 88.

When the head 18 again reaches the intersection between the legs 29 and 30 of the opening 25, the tape head 18 will contact the end of the one-way trip 106 which is aligned so that the arm 112 is depressed to move the spool in the valve 108, thereby connecting the line 80 to a line 118 and moving the spool in the air piloted valve 82. This again pressurizes line 84 and exhausts line 86 to cause the piston rod 72 to extend and move the tape head 18 toward the starting position. Again the rectangular block 24 will not catch on the corner between the legs 29 and 30 of the opening 25 because the second cylinder 70 pulls the head 18 against the adjacent wall 32 of the first leg 29. During this movement, of the head 18 along the first leg 29, the tape head 18 slides along the trip 106 in the proper direction to maintain actuation of the valve 108 until the tape head 18 moves beyond the trip 106 at the start position. This allows the valve 108 to return to its normal position, and the device 12 can again be activated by positioning the shoe 16 against a box to move the bracket 99 on the arm 46 against the roller 98, and manually depressing the trigger 15.

When the frame 13 and body 23 are made of magnesium, the entire device 12 (including protective side covers for the mechanism which were not shown) adapted for applying a strip of ½ inch wide tape about 4¼ inches long can be constructed to have a weight of less than about 8 pounds. Even this relatively small weight can, if desired, be counterweighted by attaching a counterweight device to an opening 120 in the frame 13.

The device 12 will dispense a wide variety of tapes including the very strong transparent polyester film tape reinforced with continuous glass yarn filaments which is sold under the trade designation 898 Filament Tape by Minnesota Mining and Manufacturing Company, St. Paul, Minnesota.

Operation

An end part of the supply of tape is initially positioned along the first peripheral surface portion 21 between the brushes 43 with its terminal end adjacent the second peripheral surface portion 22 of the tape head 18 defined by the leaf spring 39 (FIGS. 3 and 4).

When the shoe 16 is positioned over the edge of a box 122 to be taped (FIG. 6), the projecting edges of the arms 44 and 46, contact the box 122 and are thereby pressed to their release position against the bias of the spring 49. The bristles of the brushes 43 are thus deflected over the edges of the end part of the tape and the end part of the tape is pressed and adhered to the box 122 by the roller 35 and/or leaf spring 34 which normally project beyond the contact surface 17 of the shoe 16 as is illustrated in FIG. 5.

After the shoe is positioned over the box 122, the drive means may be manually actuated via the trigger 15 so that the tape applying head 18 will be driven from the starting position (FIG. 6) along the first leg 29 of the opening 25 toward and past the intersection of the portions of the contact surface 17 at the edge of the box (FIG. 7). During this travel the spring 34 and roller 35 move along the tape and provide a predetermined pressure to adhere the tape to one surface of the box 122. When the tape head 18 has moved so that the roller 35 has passed the edge of the box (FIG. 7), the drive means moves the head 18 (which does not pivot relative to the frame 13) along the second leg 30 of the opening 25 which is disposed at a right angle to the first leg of the opening 25. While the head 18 is moving along the second leg 30 of the opening 25, the tape is drawn along the first peripheral surface portion 21 of the head 18, and the arcuate end of the spring 39 defining the second peripheral surface portion of the head 18 biases the tape into engagement with the adjacent surface of the box (FIG. 8).

As the tape head closely approaches the finish position at the end of the second leg 30 of the opening 25, a knife 124 engages the tape extending over an opening in the body 23 along the first peripheral surface portion 21. The knife 124 has a serrated edge inclined with respect to the surfaces of the tape on the frame 13, and is mounted to the frame via a flat spring 125. The spring 125 allows the knife 124 to travel with the tape a short distance along the first peripheral surface portion 21 while the edge of the knife 124 progressively and cleanly cuts across the tape and subsequently severs the tape adjacent the second peripheral surface portion 22 of the tape head 18 (FIG. 8).

During the travel of the taping head 18 along the second leg 30 of the opening 25, the arms 44 and 46 are out of engagement with the box 122, and move to their engage position under the influence of the spring 49, deflecting the bristles of the brushes 43 over the edges of the tape which is tensioned along the first peripheral surface portion 21 by the force required to pull its adhesive surface across the rollers 54, 56, and 58. Thus the brushes 43 engage the tape adjacent its newly severed end and hold it against the spring 34 so that the new end part of the tape will be retained against the first peripheral surface portion 21 of the head 18 as the drive mechanism returns the head 18 to the start position (FIG. 5).

Also, because the arms 44 and 46 are in their engage position, the projecting ends of the arms 44 and 46 will engage and push a box from within the guide shoe 16 during return movement of the head 18 along the first leg of the opening 25 if the operator has not already removed the device 12 from the box. This means for ejecting a box from the guide shoe subsequent to taping insures that the tape along the first peripheral surface portion 21 wil not prematurely contact and adhere to a box.

In addition to the application of lengths of tape around the edge of a box, the device 12 will also apply a length of tape around a curved surface such as the periphery of a cylinder which is positioned in the guide shoe 16.

While the present invention has been described with respect to an embodiment which is preferred for applying tape around the corner of a box, numerous changes could be made in the embodiment shown, or the invention can be embodies in a form for applying tape to surfaces of other shapes without departing from the spirit of the invention. For example in the illustrated embodiment instead of the springs 34, 38, and 39 which provide means for biasing the adjacent surface of the tape head against a box in the guide shoe 16, the tape applying head could have rigid peripheral surface portions, and the entire head could then be biased against a box in the guide shoe by spring means between the tape applying head and the frame. The device could be embodied to apply tape to a planar surface by rotating the head as it moves between the starting and the finish positions, or by moving and revolving the planar surface against a stationary head, or by various combinations of movement between the head and a substrate to which tape is to be applied which: (1) afford means for positioning the tape applying head in a predetermined starting position relative to substrate with the first peripheral surface portion of the head forcefully pressing a tape end part thereon against the substrate; and (2) then causes relative sliding movement between the adjacent peripheral surface portion of the tape applying head to forcefully press the tape against the substrate until a finish position is reached at which the first peripheral portion is out of engagement with the substrate so that tape thereon will be engaged by the tape engagement means therealong and the tape is cut between the peripheral surface portions.

Thus the scope of the present invention should not be limited to the embodiment disclosed herein, but should only be interpreted in light of the language in the claims.

I claim:

1. In a device used in the application of a length of tape to a substrate from a supply length of said tape comprising a head, means mounted adjacent said head adapted to hold an end portion of the supply length of tape before and after application of a length thereof, means for defining a path for the supply length of tape to the head, and severing means for severing an applied length of tape from the supply length adjacent the head upon application of the tape, the improvement wherein said means for supporting an end portion of the tape includes a pair of brushes, said brushes each comprising a backing and a multiplicity of parallel resilient spaced bristles projecting from said backing; and mounting means for mounting said brushes one on each edge of said path with the bristles of both brushes projecting toward each other from said mounting means in a direction generally parallel with the major surfaces of the tape along the path and extending a short distance into said path, and with the bristle tips of one brush spaced from the bristle tips of the other brush so that the bristles on each brush provide releasable engagement with the edges of the tape end portion to afford disengagement of the tape from the brushes during engagement of the end portion of the tape with a substrate, and re-engagement of the edges of said tape with the brushes during the application cycle prior to severing of the applied length of tape by said severing means so that said brushes provide support for the newly formed tape end portion.

2. A device according to claim 1, wherein said head has a peripheral surface portion defining a portion of said path, and said mounting means mounts said brushes for movement relative to said head between said position on opposite edges of said path and a release position spaced from said path to afford pressing a tape end portion along said peripheral surface portion against a substrate brought closely adjacent said peripheral surface portion.

3. A device according to claim 1, wherein said bristles are of about 50 denier nylon, project about 0.15 inch from said backing, and said brushes are spaced so that the ends of the bristles on each brush project about 0.03 inch into the path.

4. A device according to claim 2 wherein said mounting means comprise a pair of arms supporting said brushes and mounted for movement relative to said head between said position on opposite edges of said path and said release position, said arms being adapted to be moved to move said brushes to said release position by contact with a said substrate moved into contact with the tape along said peripheral surface portion; and biasing means adapted for biasing said brushes to said position on opposite edges of said path over tape tensioned along said peripheral surface portion when said peripheral surface portion is sufficiently spaced from a said substrate.

5. A method for applying a length of pressure sensitive adhesive coated tape to a substrate from a supply length of the tape, comprising the steps of:

providing a pair of brushes, the brushes each comprising a backing and a multiplicity of parallel resilient spaced bristles projecting from the backing, and a support assembly for mounting the brushes one on each edge of a path for the tape with the bristles of both brushes projecting toward each other and extending a short distance into the path;

positioning an end portion of the tape between the bristles of the brushes;

pressing the end portion of the tape into engagement with the substrate while releasing engagement between the brushes and the tape;

applying the tape to the substrate;

re-engaging the supply length of tape with the bristles of the brushes during the applying step; and severing the supply length of tape from the applied length of tape adjacent the brushes so that the brushes support the newly formed end portion of the tape.

6. A method according to claim 5 wherein said support assembly is mounted on a head having a peripheral surface portion defining a portion of a path for the tape along which the brushes are normally positioned, and said applying step comprises the steps of pressing the end portion of the supply length of tape along said peripheral surface portion against a substrate by bringing said peripheral surface portion closely adjacent the substrate; and moving the brushes out of engagement with the tape along the peripheral surface portion as the peripheral surface portion is moved adjacent the substrate.

* * * * *

UNITED STATES PATENT OFFICE

CERTIFICATE OF CORRECTION

Patent No. 3,990,933 Dated November 9, 1976

Inventor(s) John T. Verch

It is certified that error appears in the above-identified patent and that said Letters Patent are hereby corrected as shown below:

Column 4, line 42, after "a" insert -- roll --.

Column 5, line 2, delete "the" first occurrence, and before "length" insert -- the --; line 31, change "FIG." to -- FIGS. --; and line 61, change "to", second occurrence to -- the --.

Column 6, line 13, change "lines" to -- line --.

Column 7, line 55, delete "the" (first occurrence).

Column 8, line 37, after "to" insert -- a --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*